US011980296B2

(12) United States Patent
Kim

(10) Patent No.: US 11,980,296 B2
(45) Date of Patent: May 14, 2024

(54) FRAME ASSEMBLY FOR FOLDING TYPE CHAIR

(71) Applicant: ING LEISURE CO., LTD., Pyeongtaek-si (KR)

(72) Inventor: Cheon Ki Kim, Pyeongtaek-si (KR)

(73) Assignee: ING LEISURE CO., LTD., Pyeongtaek-si (KR)

( * ) Notice: Subject to any disclaimer, the term of this patent is extended or adjusted under 35 U.S.C. 154(b) by 0 days.

(21) Appl. No.: 17/607,839

(22) PCT Filed: Jul. 27, 2021

(86) PCT No.: PCT/KR2021/009707
§ 371 (c)(1),
(2) Date: Oct. 29, 2021

(87) PCT Pub. No.: WO2022/181900
PCT Pub. Date: Sep. 1, 2022

(65) Prior Publication Data

US 2023/0371693 A1 Nov. 23, 2023

(30) Foreign Application Priority Data

Feb. 26, 2021 (KR) ..... 10-2021-0026260

(51) Int. Cl.

| | |
|---|---|
| ***A47C 4/04*** | (2006.01) |
| ***A47C 3/12*** | (2006.01) |
| ***A47C 4/28*** | (2006.01) |
| ***A47C 7/00*** | (2006.01) |

(52) U.S. Cl.
CPC ..... *A47C 4/04* (2013.01); *A47C 3/12* (2013.01); *A47C 4/286* (2013.01); *A47C 7/002* (2013.01)

(58) Field of Classification Search
CPC .. A47C 4/04; A47C 3/12; A47C 7/002; A47C 4/286
See application file for complete search history.

(56) References Cited

U.S. PATENT DOCUMENTS

| | | | | |
|---|---|---|---|---|
| 517,929 | A * | 4/1894 | March | A47C 9/00 248/435 |
| 8,272,684 | B2 * | 9/2012 | Obolewicz | A47C 4/286 297/16.2 |
| 8,979,184 | B2 * | 3/2015 | Stafford | A47C 9/105 297/16.2 |
| 9,339,115 | B2 * | 5/2016 | Lee | A47C 4/02 |
| 9,854,914 | B2 * | 1/2018 | Yoo | A47C 4/286 |
| 10,010,179 | B1 * | 7/2018 | Stump | A47C 4/44 |
| 10,299,599 | B2 * | 5/2019 | Browning | A47C 3/18 |
| 2009/0174233 | A1 * | 7/2009 | Hoffman | A47C 4/286 297/16.2 |
| 2014/0306493 | A1 * | 10/2014 | Obolewicz | A47C 4/42 297/16.2 |

FOREIGN PATENT DOCUMENTS

KR 10-2017-0135201 A 12/2017

* cited by examiner

*Primary Examiner* — Philip F Gabler
(74) *Attorney, Agent, or Firm* — Maschoff Brennan

(57) ABSTRACT

Disclosed is a frame assembly for a folding type chair that are folded or unfolded once by coupling a plurality of upper and lower supports configuring a main frame of a chair to be operatively associated.

7 Claims, 10 Drawing Sheets

FRAME ASSEMBLY FOR FOLDING TYPE CHAIR

FIELD OF INVENTION

The present invention relates to a frame assembly for a folding type chair, and more particularly to a frame assembly for a folding type chair that are folded or unfolded once by coupling a plurality of upper and lower supports configuring a main frame of a chair to be operatively associated, thereby improving user convenience and stably supporting the load of the user.

BACKGROUND OF INVENTION

In general, a folding type chair is designed to fold or unfold a frame forming a main frame, and thus is easily carried or installed. The folding type chair of this structure is mainly and easily used in a campsite or various places in which a chair is needed.

Such a conventional folding type chair has been previously applied by the present applicant as Korean Patent Publication No. 10-2017-0135201 (published date: Dec. 8, 2017).

In detail, referring to FIG. 1, a conventional folding type chair 1 includes an upper block 10 having an outer circumference to which a plurality of supports 11 are pivotally coupled, and a lower block 20 coupled to a lower portion of the upper block 10 and having an outer circumference to which a plurality of supports 21 is pivotably coupled up and down. The upper block 10 is provided with a seat 30 on which a user is capable of sitting by coupling a corner portion to each end of the support in the state in which the plurality of supports 11 are spread upward.

However, the plurality of supports included in the aforementioned folding type chair 1 is independently and pivotably hinged to the upper block 10 and the lower block 20. Thus, when the chair is folded (refer to FIG. 2) or unfolded, it is cumbersome to turn and operate the plurality of supports one by one.

TECHNICAL SOLUTION

Therefore, the present invention provides a frame assembly for a folding type chair that are folded or unfolded once by coupling a plurality of upper and lower supports configuring a main frame of a chair to be operatively associated

TECHNICAL GOAL OF THE INVENTION

To achieve the technical goal, the present invention provides a frame assembly for a folding type chair, including an upper bracket provided with a first through hole formed in upward and downward directions, a plurality of upper supports radially arranged on an outer circumference of the upper bracket and having respective ends coupled to each other using a hinge shaft as a medium to be turned up and down, a lower bracket coupled to a lower part of the upper bracket to idle with respect to a central axis of the first through hole and including a second through hole connected to the first through hole, a plurality of lower supports radially arranged on an outer circumference of the lower bracket and having respective ends coupled to each other using a hinge shaft as a medium to be turned up and down, and an ascending and descending shaft that is coupled to and sliding within the first through hole and the second through hole, and in which a first extension extending by a predetermined length from one end of the upper support is rotatably coupled to a first coupling hole of an upper outer circumference and a second extension extending by a predetermined length from one end of the lower support is rotatably coupled to a second coupling hole of a lower outer circumference, wherein the frame assembly for the folding type chair is integrally folded or unfolded while the lower supports are operatively associated using the ascending and descending shaft as a medium when the upper supports are folded or unfolded.

In this case, the upper supports and the lower supports may be provided in a corresponding number to be supported by three or four points and are folded or unfolded while being turned in the same direction.

The upper supports may be coupled to respective corners of a seat to allow a user to sit thereon when the upper supports are unfolded.

A length of each of the upper supports may be adjusted using a telescope method.

The first coupling hole and the second coupling hole may be formed as a long hole having a predetermined length to operatively associate the upper and lower supports and the ascending and descending shaft.

An upper end of a central axis of a tube body may be fixedly fitted into the first through hole of the upper bracket, a snap ring may be fitted into and coupled to a groove portion that is exposed by inserting a lower end of the central axis into a second through hole of the lower bracket to pass through the second through hole, and the lower bracket may be capable of being idling.

A flange portion provided with an insertion hole that is fixedly coupled to a bottom surface of the upper bracket using a coupling member as a medium may be integrally formed on a periphery of the central axis.

EFFECT OF INVENTION

A frame assembly for a folding type chair according to the present invention as configured above may be integrally folded or unfolded while being operatively associated with a lower support using an ascending and descending shaft as a medium when at least two of a plurality of upper supports are folded in the state of being held at opposite sides. Accordingly, the folding type chair may be simply unfolded to be installed and unfolded.

BEST MODE

Figure 1:
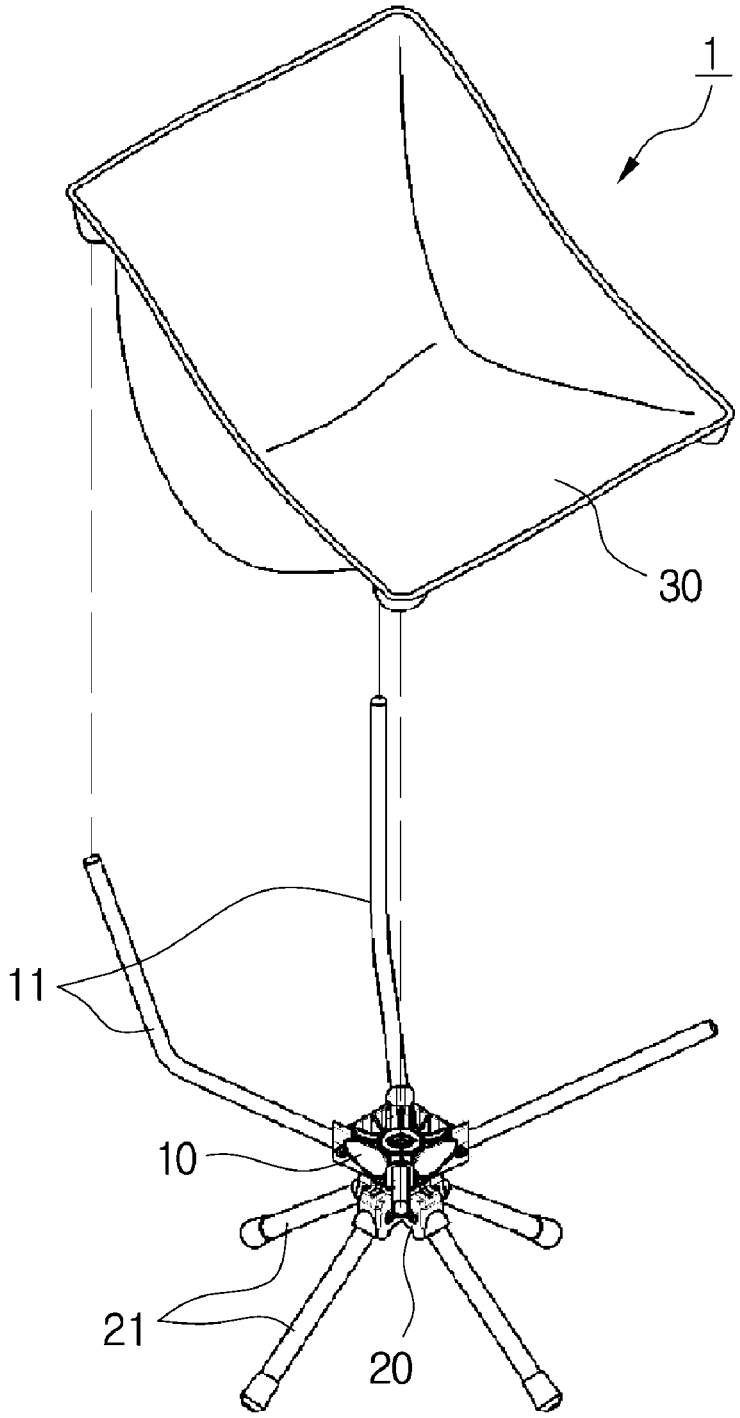
FIG. 1 is an exploded perspective view showing a structure of a frame of a conventional folding type chair.
Figure 2:
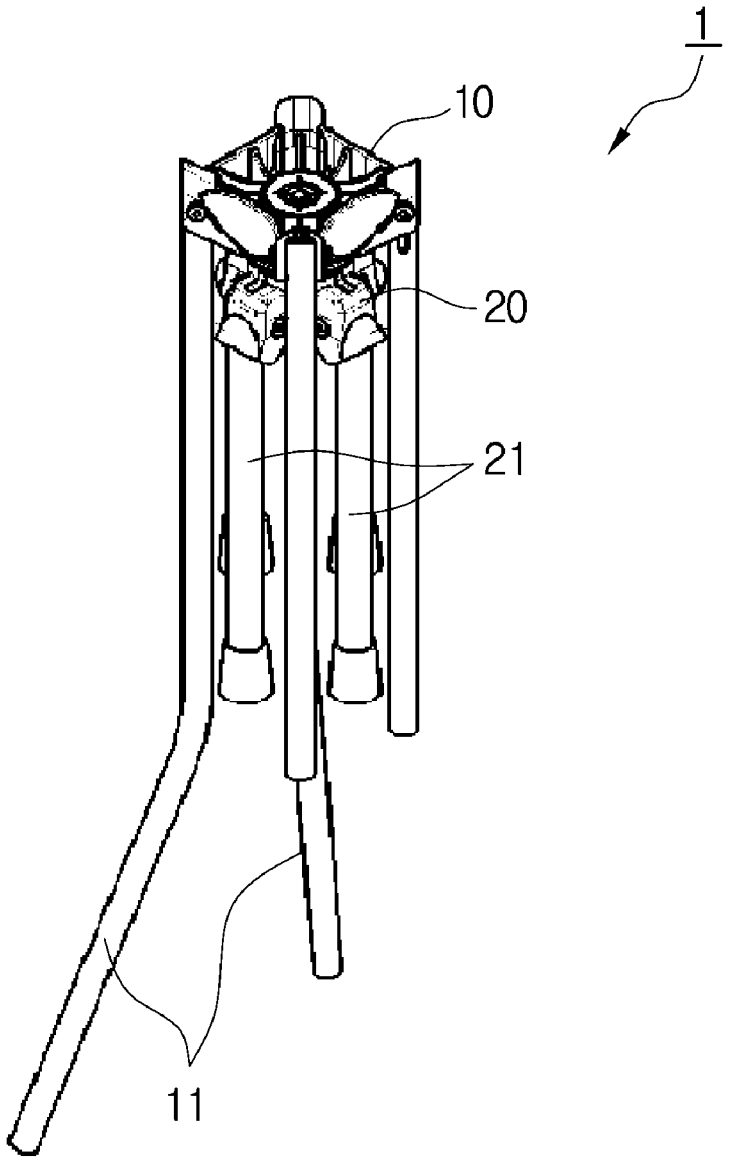
FIG. 2 is a perspective view showing the state in which the frame of the folding type chair of FIG. 1 is folded.

Hereinafter, configuration and operation of embodiments of the present invention will be described in detail with reference to the accompanying drawings.

In the following description of the present invention, a detailed description of known functions and configurations incorporated herein will be omitted when it may make the subject matter of the present invention unclear.

In the specification, when a certain part is said to "include" a certain component, this indicates that the part may further include another component, rather than necessarily excluding the other component, unless there is a disclosure to the contrary.

In the following description, like reference numerals designate like elements although the elements are shown in different drawings.

Figure 3:
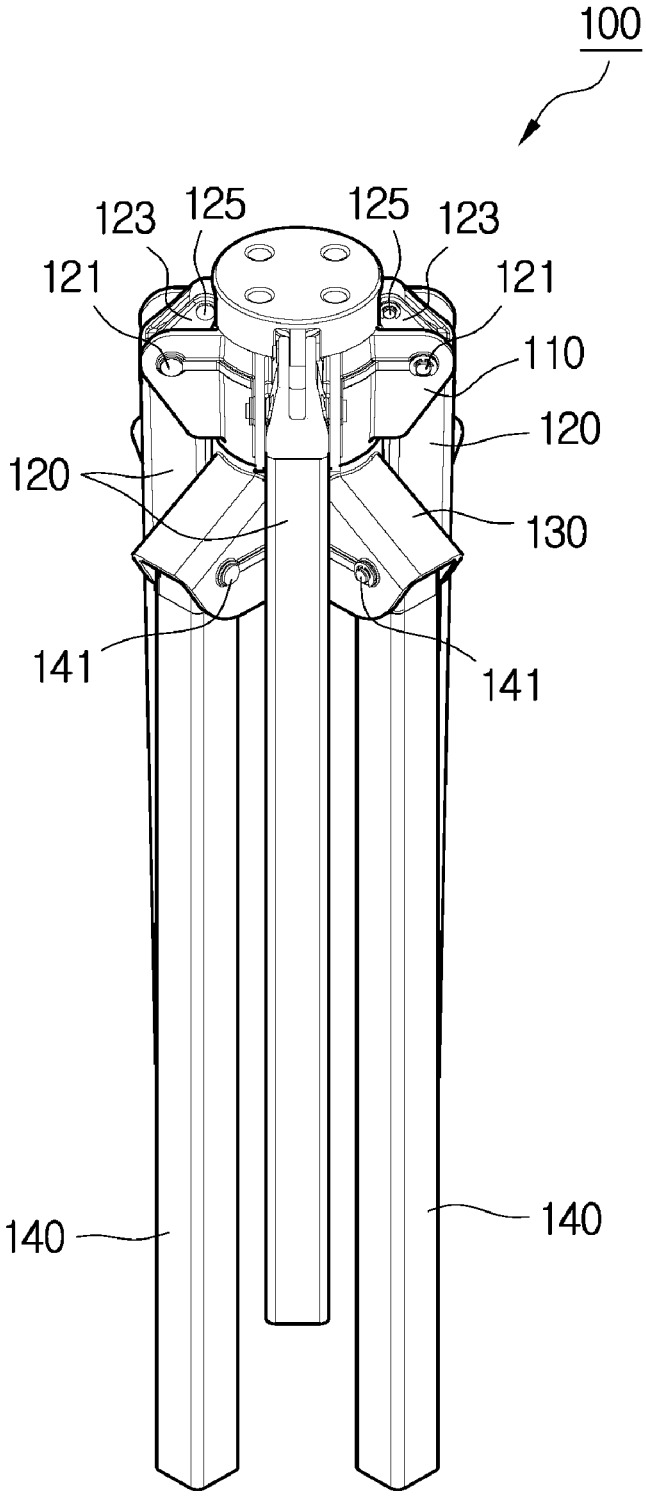
FIG. 3 is a perspective view showing the state in which a frame assembly of a folding type chair is folded according to the present invention.
Figure 4:
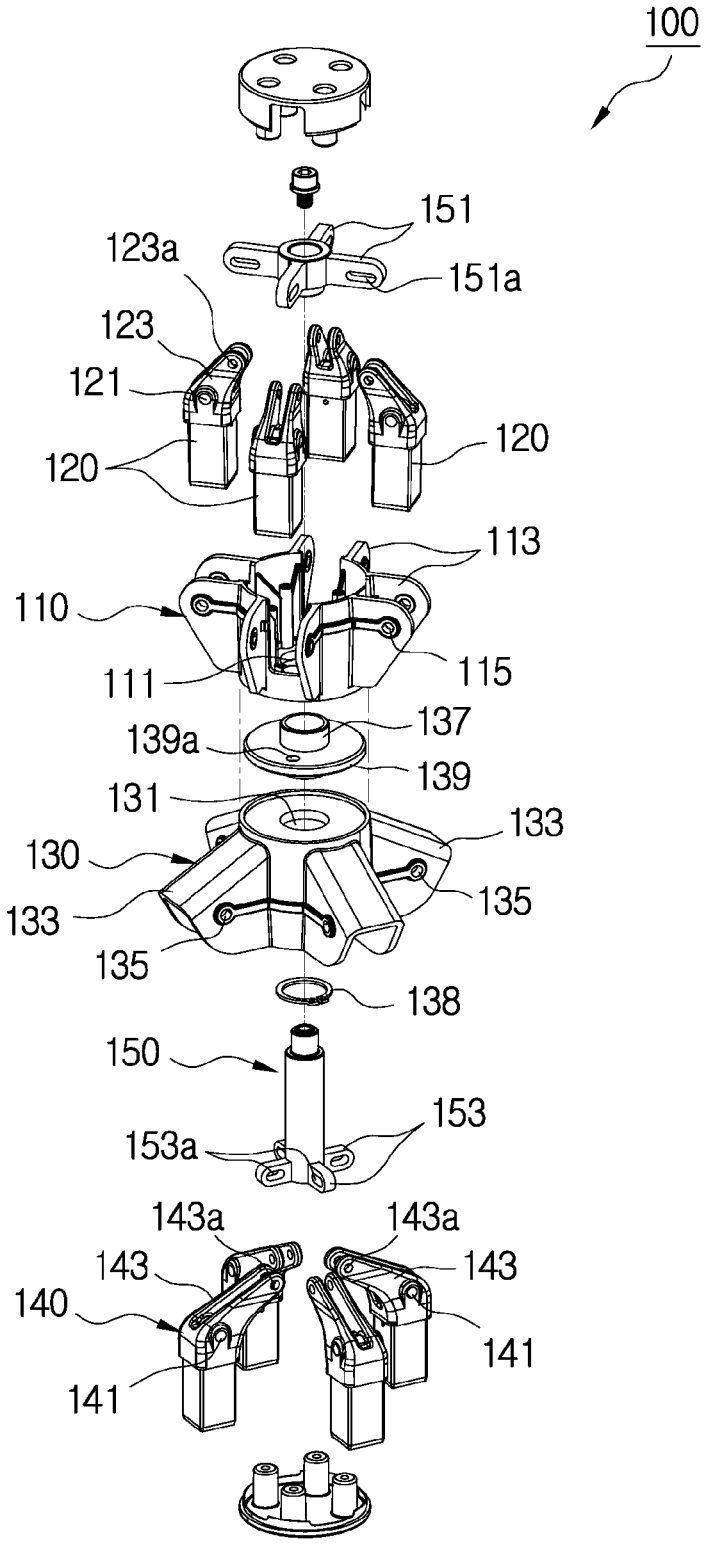
FIG. 4 is an exploded perspective view of a frame assembly for a folding type chair according to the present invention.

FIG. 3 is a perspective view showing the state in which a frame assembly for a folding type chair is folded according the present invention. FIG. 4 is an exploded perspective view of a frame assembly for a folding type chair according to the present invention.

Referring to FIG. 3, a frame assembly for a folding type chair 100 according to an embodiment of the present invention may include an upper bracket 110, an upper support 120, a lower bracket 130, a lower support 140, and an ascending and descending shaft 150 (refer to FIG. 4).

The configuration according to the present invention will be described in detail.

Figure 5:
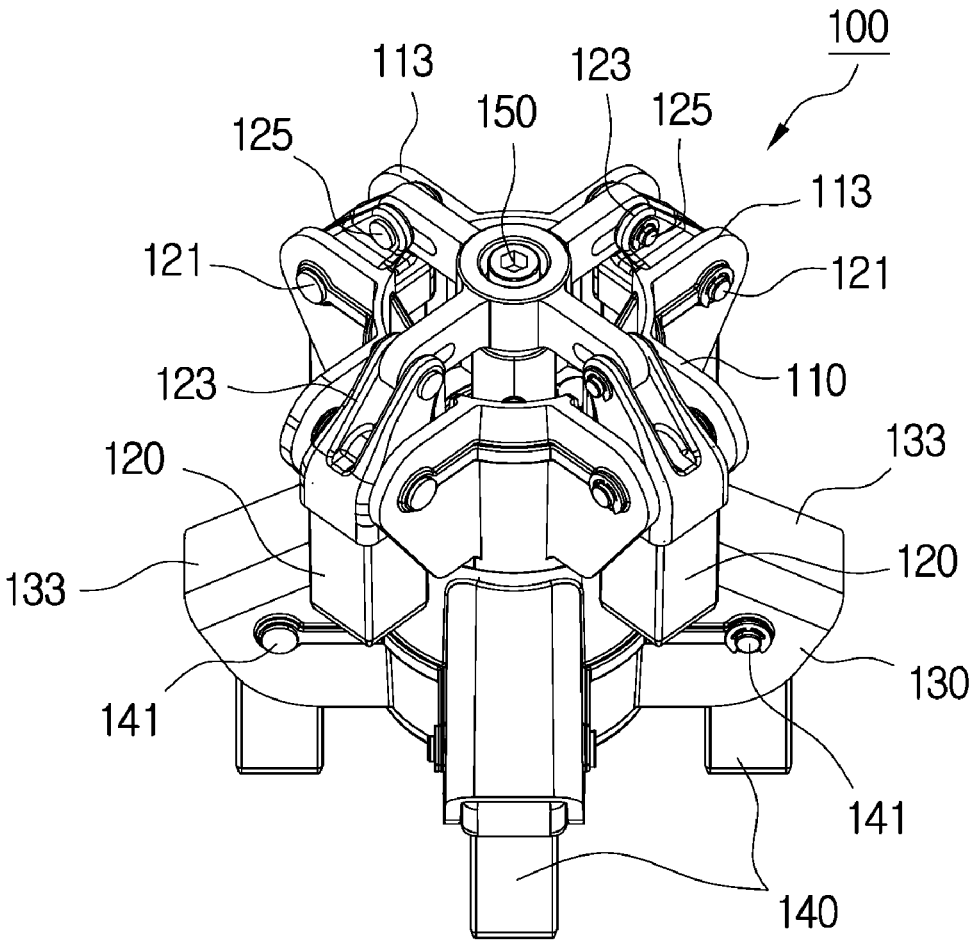
FIGS. 5 and 6 are perspective views of main components in the state in which a frame assembly for a folding type chair is folded and unfolded according to the present invention.
Figure 6:
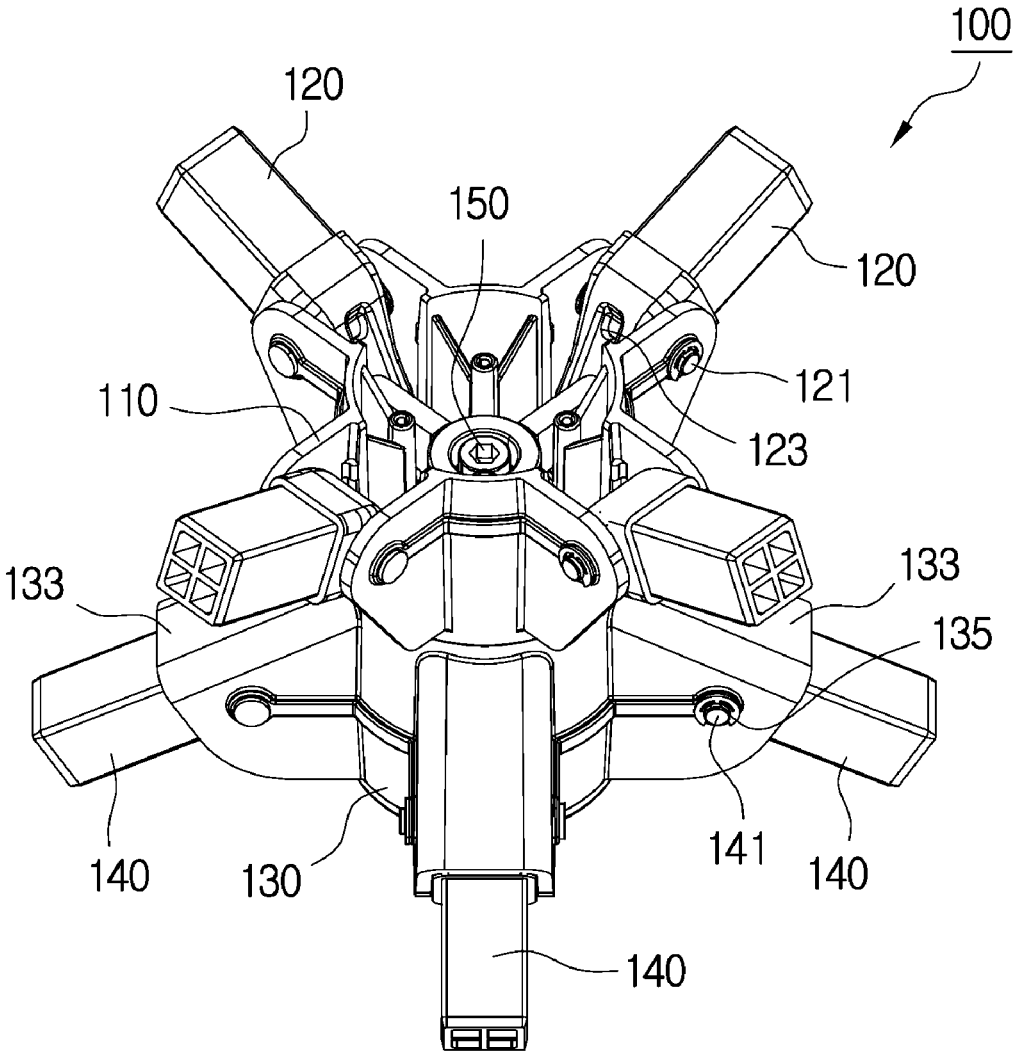

Referring to FIGS. 4 to 6, the upper bracket 110 may include a first through hole 111 in upward and downward directions of a body. A plurality of first couplers 113 provided with a hinge hole 115 formed therein may be radially formed on an outer circumference of the upper bracket 110 to allow the upper support 120 described below to be coupled to the hinge hole 115.

The upper support 120 may have one end coupled to the plurality of first couplers 113, which is radially arranged on the outer circumference of the upper bracket 110, using a hinge shaft 121 as a medium and thus may be turned up and down.

The upper support 120 may have one end provided with a first extension 123 that extends by a predetermined length to be rotatably coupled to the ascending and descending shaft 150 described below in the state in which the upper support 120 is coupled to the hinge shaft 121. The first extension 123 may include a pin coupling hole 123*a*.

Figure 10:
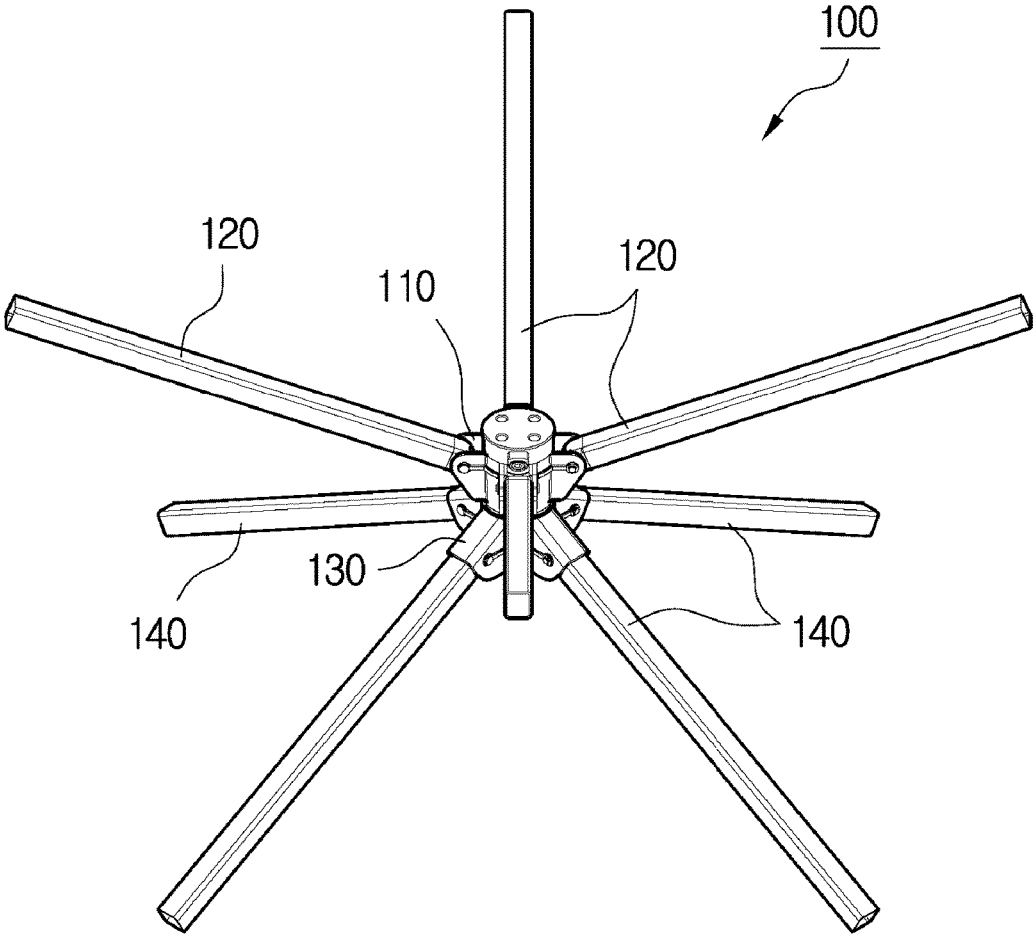
FIG. 10 is a perspective view showing the state in which a frame assembly for a folding type chair is unfolded according to the present invention.

Each corner of a seat 30 (refer to FIG. 1) may be coupled to the upper support 120 when the upper support 120 is operated to be turned and unfolded upward (refer to FIG. 10), and a user may seat on the seat 30 that is coupled to the upper support 120 as such.

A telescope method (not shown) may be applied to adjust the length of the upper support 120 when the seat 30 is coupled to the upper support 120.

At least four upper supports 120 may be radially arranged to stably support user's buttocks.

According to the present invention, the seat 30 may be manufactured separately and may be coupled to an end of the upper support 120 in an integral or separate manner. According to the present invention, the seat 30 may be maintained in the state of being coupled to the upper support 120 in an integral manner by a separate coupling member and may be transferred and stored by being folded to surround the frame assembly 100 in the state in which the frame assembly for a folding type chair 100 according to the present invention is folded.

Related known technologies may be applied in various ways to installation of the seat 30 and adjustment of the length of the upper support 120, and a detailed description of known functions and configurations incorporated herein will be omitted when it may make the subject matter of the present invention unclear.

Figure 7:
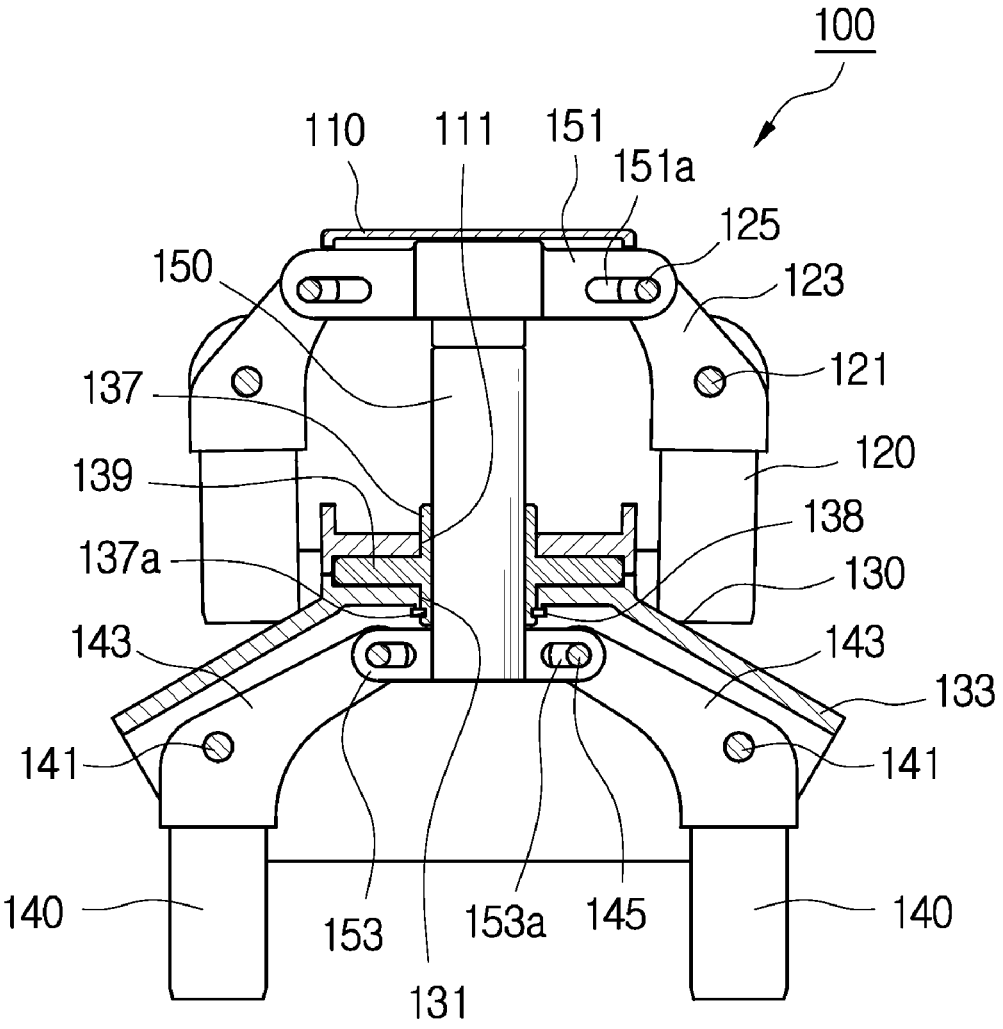
FIGS. 7 and 8 are side views showing a frame assembly for a folding type chair is folded and unfolded according to the present invention.

Referring to FIG. 7, the lower bracket 130 may be coupled to a lower part of the upper bracket 110 to idle with respect to a central axis of the first through hole 111. The lower bracket 130 may include a second through hole 131 connected to the first through hole 111 on a central axis of the body.

A plurality of second couplers 133 provided with a hinge hole 135 (refer to FIG. 4) formed therein may be radially formed on an outer circumference of the lower bracket 130.

In detail, a detailed coupling structure of the upper and lower brackets 110 and 130 is now described, and an upper end of a central axis 137 of a tube body may be fixedly fitted into the first through hole 111 of a bottom surface of the upper bracket 110. A snap ring (C type retaining ring) 138 may be fitted into and coupled to a groove portion 137*a* that is exposed by inserting a lower end of the central axis 137 into the second through hole 131 of an upper surface of the lower bracket 130 to pass through the second through hole 131. Accordingly, the lower bracket 130 may become in the state in which idling is possible.

In this case, a flange portion 139 provided with an insertion hole 139*a* (refer to FIG. 4) that is fixedly coupled to a bottom surface of the upper bracket 110 using a coupling member (not shown) such as a bolt as a medium may be integrally formed on a periphery of the central axis 137.

Figure 8:
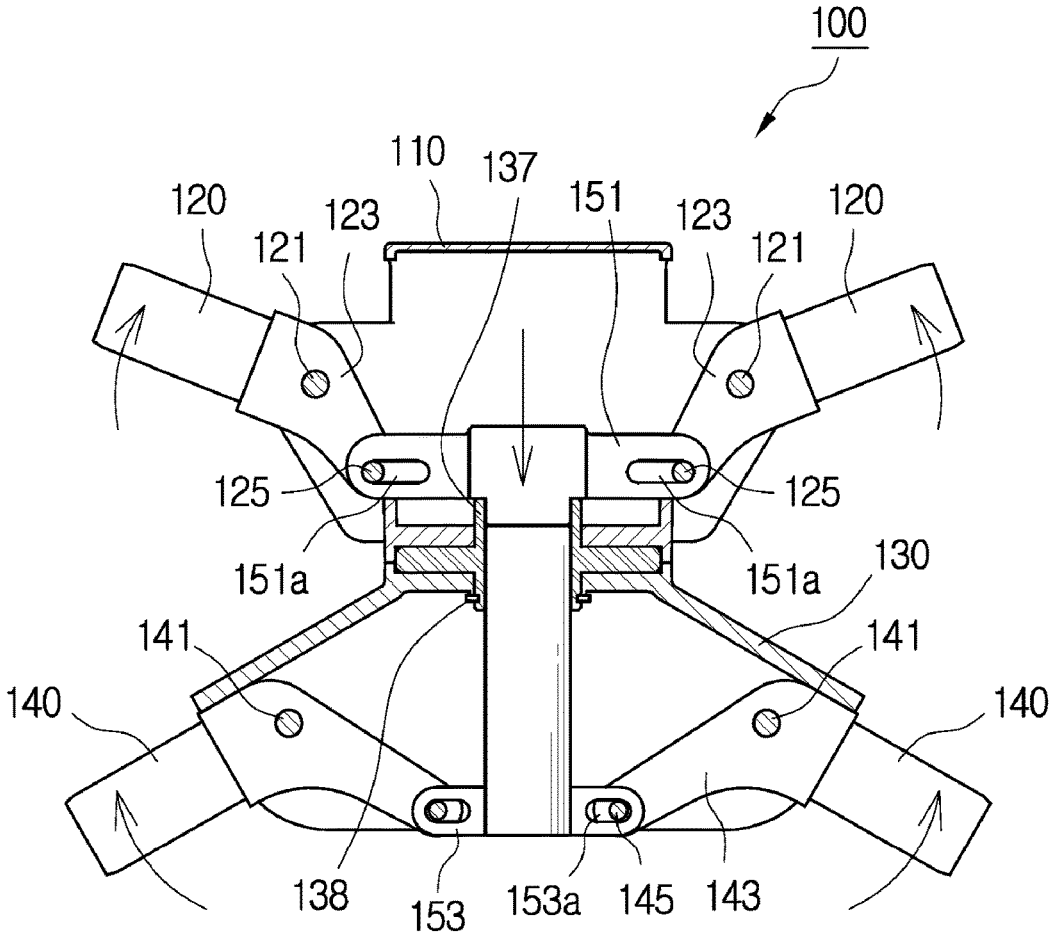

Referring to FIG. 8, an end of the lower support 140 may be pivotably coupled up and down to each of the second couplers 133 that are radially arranged on the outer circumference of the lower bracket 130 using a hinge shaft 141 as a medium.

A second extension 143 that extends by a predetermined length may be disposed on one end of the lower support 140 in such a way that the lower support 140 is rotatably connected to the ascending and descending shaft 150 described below in the state of being coupled to the hinge shaft 141. A pin coupling hole 143*a* (refer to FIG. 4) may be formed in the second extension 143.

The lower support 140 may be in contact with the ground when unfolding at a predetermined angle (refer to FIG. 10) and may function as a leg of the folding type chair.

In this case, the lower support 140 may be provided in four to be supported by four points of the ground on which the folding type chair is to be installed. According to the present invention, although an example in which each of the upper and lower supports 120 and 140 is provided in four has been described, the present invention may be applied to a modification example in which each of the upper and lower supports 120 and 140 is provided in three to be supported by three points.

The upper support 120 and the lower support 140 may be folded and unfolded while being turned in the same direction. In this case, the upper support 120 may be rotated based on the central axis of the first through hole 111, and thus the upper support 120 may be folded and accommodated in a space between the lower supports 140 while the upper and lower supports 120 and 140 are folded. Thus, the folding type chair may be folded and stored to a minimum volume when folded (refer to FIG. 3).

A folding or unfolding structure of the upper support 120 and the lower support 140 will be described in detail with the ascending and descending shaft 150 to be described below.

Figure 9:
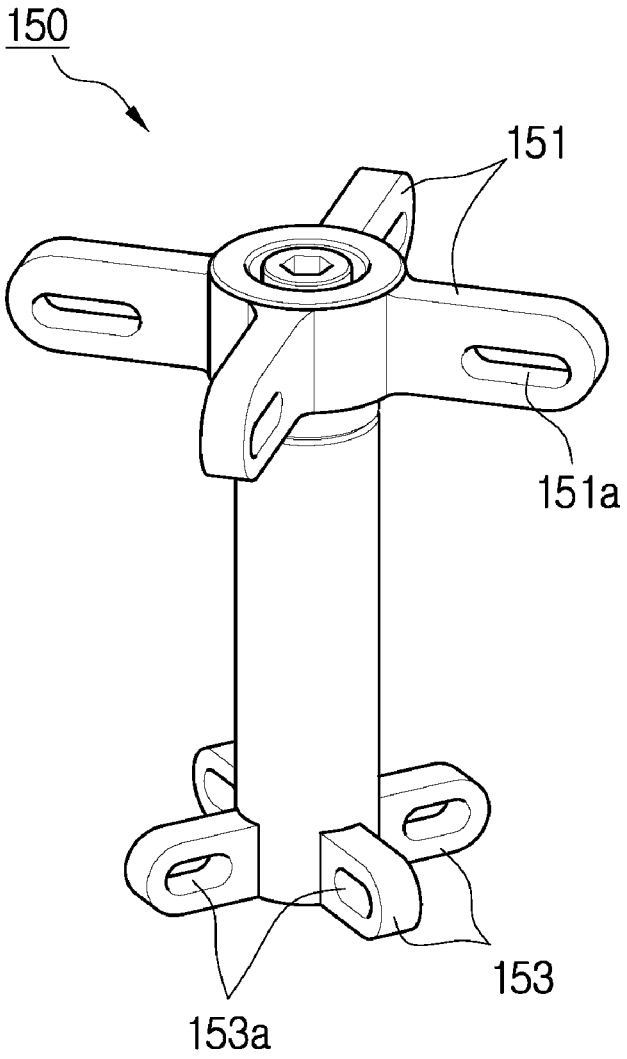
FIG. 9 is a perspective view of an ascending and descending shaft according to the present invention.

Referring back to FIGS. 4 and 9, the ascending and descending shaft 150 may connect the upper and lower supports 120 and 140 to each other to be integrally operated when the upper and lower supports 120 and 140 are folded or unfolded. The ascending and descending shaft 150 may be coupled to and slide within the first through hole 111 of the upper bracket 110 and the second through hole 131 of the lower bracket 130.

In detail, upper structures 151 provided with a first coupling hole 151*a* may radially protrude on an upper outer circumference of the ascending and descending shaft 150, and lower structures 153 provided with a second coupling hole 153*a* may radially protrude on a lower outer circumference of the ascending and descending shaft 150. That is, the upper and lower structures 151 and 153 of the ascending and descending shaft 150 may be exposed out of the first and second through holes 111 and 131, and a middle part of the body of the ascending and descending shaft 150 that is formed by a predetermined length may be slidably coupled to the first and second through holes 111 and 131 to reciprocate therein.

In this case, the upper structures 151 and the lower structures 153 of the ascending and descending shaft 150 may be provided in the number corresponding to the upper and lower supports 120 and 140.

In the ascending and descending shaft 150 of this structure, the first extension 123 that extends by a predetermined length from one end of the upper support 120 may be rotatably coupled to the first coupling hole 151*a* of the upper structures 151 using a fixing pin 125 as a medium.

In addition, the second extension 143 that extends by a predetermined length from one end of the lower support 140 may be rotatably coupled to the second coupling hole 153*a* of the lower structures 153 using a fixing pin 145 as a medium.

In this case, the first coupling hole 151*a* and the second coupling hole 153*a* may be formed as long holes having a predetermined length to operatively associate the upper and lower supports 120 and 140 and the ascending and descending shaft 150.

That is, when all of the first and second coupling holes 151*a* and 153*a* of the ascending and descending shaft 150 and the pin coupling holes 123*a* and 143*a* of the upper and lower supports 120 and 140 connected thereto are formed as a circular hole, the upper and lower supports 120 and 140 may be completely fixed to the ascending and descending shaft 150, and thus the ascending and descending shaft 150 may not slidably reciprocate. That is, the upper and lower supports 120 and 140 may not be capable of being turned.

Thus, in order to turn the upper and lower supports 120 and 140, any one of the first and second coupling holes 151*a* and 153*a* and the pin coupling holes 123*a* and 143*a* needs to be formed as a long hole.

In this case, according to the present invention, although an example in which the first coupling hole 151*a* and the second coupling hole 153*a* are formed as a long hole has been described above, the present invention is not limited thereto, and the present invention may be applied to a modification example in which the fixing pin coupling holes 123*a* and 143*a* included in the first extension 123 and the second extension 143 instead of the first coupling hole 151*a* and the second coupling hole 153*a* are formed as a long hole.

The frame assembly for a folding type chair 100 according to the present invention as configured above may be integrally folded or unfolded while being operatively associated with the lower support 140 using the ascending and descending shaft 150 as a medium when at least two of the plurality of upper supports 120 are folded (refer to FIG. 7) or unfolded (refer to FIG. 8) in the state of being held at opposite sides. Accordingly, the folding type chair may be simply unfolded to be installed and unfolded.

Although the present invention has been illustrated and described above with reference to specific embodiments, the present invention is not limited to the aforementioned embodiments, and various changes and modifications are possible without departing from the technical spirit of the present invention.

DESCRIPTION OF REFERENCE NUMERALS

| | | | |
|---|---|---|---|
| 100: | frame assembly | 110: | upper bracket |
| 111: | first through hole | 113: | first coupler |
| 115: | hinge hole | 120: | upper support |
| 121: | hinge shaft | 123: | first extension |
| 123a: | hole | 125: | fixing pin |
| 130: | lower bracket | 131: | second through hole |
| 133: | second coupler | 135: | hinge hole |
| 137: | central axis | 137a: | groove portion |
| 138: | snap ring | 139: | flange portion |
| 139a: | insertion hole | 140: | lower support |
| 141: | hinge shaft | 143: | second extension |
| 143a: | hole | 145: | fixing pin |
| 150: | ascending and descending shaft | | |
| 151: | upper structure | | |
| 151a: | first coupling hole | | |
| 153: | lower structure | | |
| 153a: | second coupling hole | | |

The invention claimed is:

1. A frame assembly for a folding type chair, comprising:

an upper bracket provided with a first through hole formed in upward and downward directions;

a plurality of upper supports radially arranged on an outer circumference of the upper bracket and having respective ends hinge-coupled to the upper bracket using a plurality of first hinge shafts to be turned up and down;

a lower bracket coupled to a lower part of the upper bracket to be rotatable with respect to a central axis of the first through hole and including a second through hole connected to the first through hole;

a plurality of lower supports radially arranged on an outer circumference of the lower bracket and having respective ends hinge-coupled to the lower bracket using a plurality of second hinge shafts to be turned up and down; and an ascending and descending shaft that is coupled to and sliding within the first through hole and the second through hole, and in which a first extension extending by a predetermined length from one end of the upper support is rotatably coupled to a first coupling hole of an upper outer circumference and a second extension extending by a predetermined length from one end of the lower support is rotatably coupled to a second coupling hole of a lower outer circumference, wherein:

the frame assembly for the folding type chair is integrally folded or unfolded while the lower supports are operatively associated using the ascending and descending shaft when the upper supports are folded or unfolded, and the upper supports and the lower supports are turned in the same direction when they are folded or unfolded.

2. The frame assembly for the folding type chair according to claim 1, wherein the upper supports and the lower supports are provided to be supported by three or four points.

3. The frame assembly for the folding type chair according to claim 1, wherein the upper supports are coupled to respective corners of a seat to allow a user to sit thereon when the upper supports are unfolded.

4. The frame assembly for the folding type chair according to claim 3, wherein a length of each of the upper supports is adjusted using a telescope method.

5. The frame assembly for the folding type chair according to claim 1, wherein a flange portion provided with an insertion hole that is fixedly coupled to a bottom surface of the upper bracket using a coupling member is integrally formed on a periphery of the central axis.

6. The frame assembly for the folding type chair according to claim 1, wherein the first coupling hole and the second coupling hole are formed as long holes having a predetermined length to operatively associate the upper and lower supports and the ascending and descending shaft.

7. The frame assembly for the folding type chair according to claim 1, wherein:

an upper end of a central axis of a tube body is fixedly fitted into the first through hole of the upper bracket, a snap ring is fitted into and coupled to a groove portion that is exposed by inserting a lower end of the central axis into a second through hole of the lower bracket to pass through the second through hole such that the lower bracket is rotatable with respect to the central axis of the first through hole;

the plurality of upper supports are hinge-coupled to a plurality of first extensions that extend by a predetermined length from one end of each of the plurality of the upper supports and each of the plurality of the first extensions is rotatably coupled to the first coupling hole using a first fixing pin; and the plurality of lower supports are hinge-coupled to a plurality of second extensions that extend by a predetermined length from one end of the lower support and each of the plurality of the second extensions is rotatably coupled to the second coupling hole of the lower structures using a second fixing pin.

* * * * *